US006401942B1

(12) United States Patent
Eckert

(10) Patent No.: US 6,401,942 B1
(45) Date of Patent: Jun. 11, 2002

(54) TRANSFORMABLE DISPLAY AND HOLDING DEVICE

(76) Inventor: Michael P. Eckert, 575 Evanston, Lake Bluff, IL (US) 60044

( * ) Notice: Subject to any disclaimer, the term of this patent is extended or adjusted under 35 U.S.C. 154(b) by 0 days.

(21) Appl. No.: 09/519,490

(22) Filed: Mar. 6, 2000

(51) Int. Cl.[7] ..... A47F 1/00
(52) U.S. Cl. ..... 211/59.3; 211/184
(58) Field of Search ..... 211/59.2, 59.3, 211/59.4, 184, 175, 43, 46, 120, 45, 50–51; 108/61; 312/61, 71

(56) References Cited

U.S. PATENT DOCUMENTS

| | | | | | |
|---|---|---|---|---|---|
| 3,110,401 | A | | 11/1963 | Mogulescu | |
| 3,308,961 | A | | 3/1967 | Chesley | |
| 4,552,272 | A | * | 11/1985 | Field | 211/88.01 |
| 4,762,236 | A | | 8/1988 | Jackle, III et al. | |
| 4,830,201 | A | | 5/1989 | Breslow | |
| 4,836,390 | A | * | 6/1989 | Polvere | 211/59.3 |
| 5,097,962 | A | * | 3/1992 | Eklof et al. | 211/59.2 |
| 5,240,126 | A | * | 8/1993 | Foster et al. | 211/59.3 |
| 5,341,945 | A | * | 8/1994 | Gibson | 211/184 |
| 5,353,939 | A | * | 10/1994 | Beeler et al. | 211/59.3 |
| 5,366,099 | A | | 11/1994 | Schmid | |
| 5,390,802 | A | * | 2/1995 | Pappagallo et al. | 211/59.3 |
| 5,469,976 | A | * | 11/1995 | Burchell | 211/59.3 |
| 5,542,552 | A | * | 8/1996 | Yablans et al. | 211/59.3 |
| 5,638,963 | A | * | 6/1997 | Finnelly et al. | 211/59.3 |
| 5,673,801 | A | * | 10/1997 | Markson | 211/59.3 |
| 5,738,019 | A | * | 4/1998 | Parker | 108/61 |
| 5,746,328 | A | * | 5/1998 | Beeler et al. | 211/59.3 |
| 5,855,281 | A | | 1/1999 | Rabas | |
| 5,992,652 | A | * | 11/1999 | Springs | 211/59.3 |
| 6,015,051 | A | * | 1/2000 | Battaglia | 211/59.3 |
| 6,082,557 | A | * | 7/2000 | Leahy | 211/59.3 |
| 6,105,791 | A | * | 8/2000 | Chalson et al. | 211/59.3 |
| 6,142,317 | A | * | 11/2000 | Merl | 211/59.3 |

* cited by examiner

*Primary Examiner*—Daniel P. Stodola
*Assistant Examiner*—Jennifer E. Novosad
(74) *Attorney, Agent, or Firm*—Michael R. McKenna

(57) ABSTRACT

A point of sale display tray with multiple rows and product advance for each row that transforms the number of rows to accommodate varying sizes of display product and still provides product advance for each row without the need of removing parts. The point of sale display tray is a display and holding device that transforms from a primary configuration with a number of primary bays to a secondary configuration with a reduced number of secondary bays.

25 Claims, 12 Drawing Sheets

TRANSFORMABLE DISPLAY AND HOLDING DEVICE

BACKGROUND OF THE INVENTION

This invention relates to a display and holding device that transforms from a primary configuration with a number of primary bays to a secondary configuration with a reduced number of secondary bays.

In the primary configuration, the display and holding device comprises a plurality of primary bays and a plurality of object advancers equal in number to the number of the plurality of primary bays. One of the plurality of object advancers is disposed in each of the plurality of primary bays.

Each of the plurality of object advancers is moveable along a path between a forward position proximate to a front wall and an aft position proximate to a back wall. At least one of a first side wall and a second side wall is selectively moveable laterally between a primary position in which the selectively moveable at least one of the first side wall and the second side wall is disposed between two adjacent paths and a secondary position in which the selectively moveable at least one of the first side wall and the second side wall is disposed along one of the two adjacent paths while the object advancer aligned in the one of the two adjacent paths is disposed in the aft position.

Transformation occurs as the object advancer aligned in the one of the two adjacent paths is disposed proximate to the aft position and the selectively moveable at least one of the first side wall and the second side wall is moved to the secondary position in line with the one of the two adjacent paths. The forward movement of the object advancer aligned in the one of the adjacent paths is secured in an immobile position proximate the back wall by the selectively moveable at least one of the first side wall and the second side wall disposed in the secondary position.

The invention can be used as a point of sale display tray for video tapes either in plastic boxes and/or paper boxes and DVD cases which is transformable from a tray displaying a plurality of rows of paper boxed video tapes to a tray displaying said plurality of rows minus at least one of the plastic boxed video tapes (which are larger in size than the paper boxed tapes) comprising a tray having a plurality of spring biased hands to move the tapes to a front side of the tray.

Prior art devices have less structural integrity in that they use adjustable framing devices, as in U.S. Pat. No. 4,830,201, which cannot easily be modified and which fails to provide a portable devise which can readily be moved with the display product intact from one display location to another. Similarly, U.S. Pat. Nos. 5,562,217 and 5,634,564 require the addition of distinct modules to vary the number of bays.

To alleviate these problems, and others which will become apparent from the disclosure which follows, the present invention conveniently provides one tray unit with a plurality of primary display bays and integral dividers that slidably relocate to accommodate display products of varying sizes while maintaining an operable object advancer for each of the primary display bays and for the newly transformed secondary bays.

The citation of the foregoing publications is not an admission that any particular publication constitutes prior art, or that any publication alone or in conjunction with others, renders unpatentable any pending claim of the present application. None of the cited publications is believed to detract from the patentability of the claimed invention.

Still other advantages will be apparent from the disclosure that follows.

SUMMARY OF THE INVENTION

The invention relates to a display and holding device that transforms from a primary configuration with a number of primary bays to a secondary configuration with a reduced number of secondary bays.

The display and holding device comprises a plurality of primary bays and a plurality of object advancers equal in number to the number of the plurality of primary bays. One of the plurality of object advancers is disposed in each of the plurality of primary bays.

Each of the plurality of primary bays is defined by a portion of a front wall, a first side wall and a second side wall, a portion of a bottom wall, and a portion of a back wall. The front wall is parallel to the back wall. The front wall further has a bottom edge connected to a front edge of the bottom wall. The bottom wall further has a back edge connected to a bottom edge of the back wall, and each of the side walls is perpendicular to and extending from the front wall.

Each of the plurality of object advancers is moveable along a path between a forward position proximate to the front wall and an aft position proximate to the back wall. At least one of the first side wall and the second side wall is selectively moveable laterally between a primary position in which the selectively moveable at least one of the first side wall and the second side wall is disposed between two adjacent paths and a secondary position in which the selectively moveable at least one of the first side wall and the second side wall is disposed along one of the two adjacent paths while the object advancer aligned in the one of the two adjacent paths is disposed in the aft position.

Transformation occurs as the object advancer aligned in the one of the two adjacent paths is disposed proximate to the aft position and the selectively moveable at least one of the first side wall and the second side wall is moved to the secondary position in line with the one of the two adjacent paths. The forward movement of the object advancer aligned in the one of the adjacent paths is secured in an immobile position proximate the back wall by the selectively moveable at least one of the first side wall and the second side wall disposed in the secondary position.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWING

Preferred embodiments of the invention are described hereinafter with reference to the accompanying drawing wherein.

DETAILED DESCRIPTION OF THE INVENTION

Figure 13:
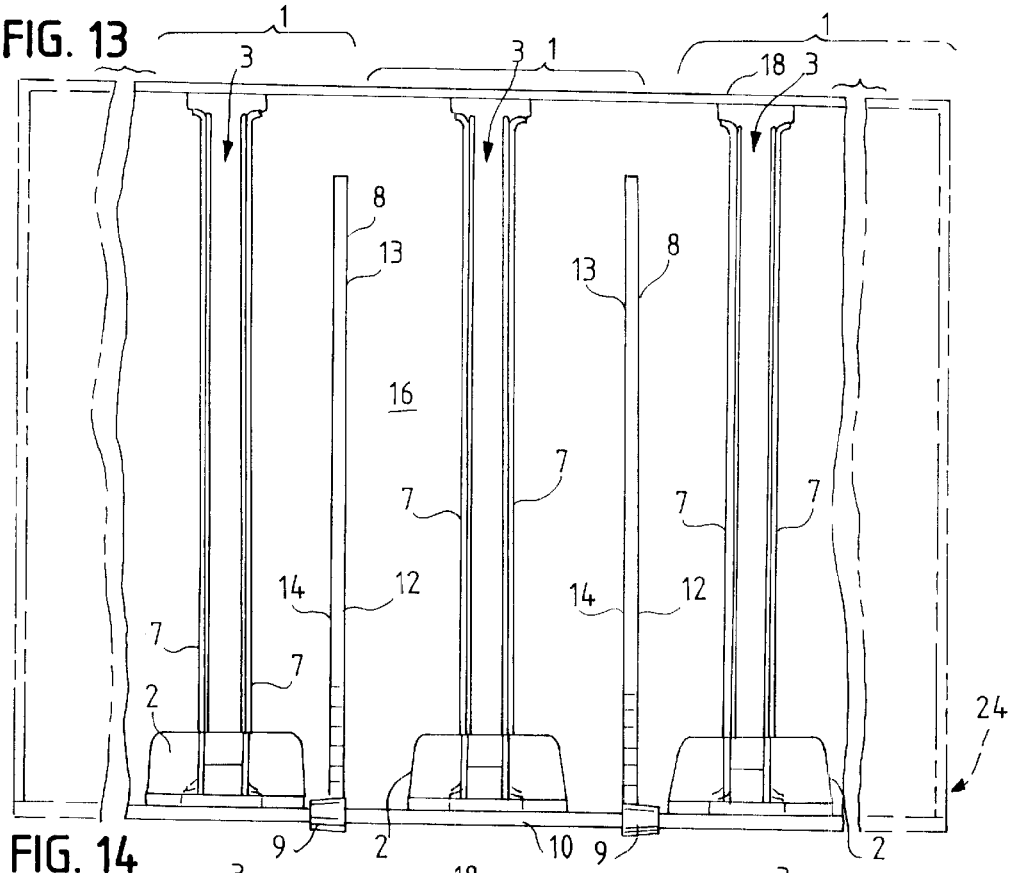
FIG. 13 is a fragmentary top plan view of another preferred embodiment of the display and holding device of the present invention showing one of a plurality of primary bays separated by side walls.
Figure 14:
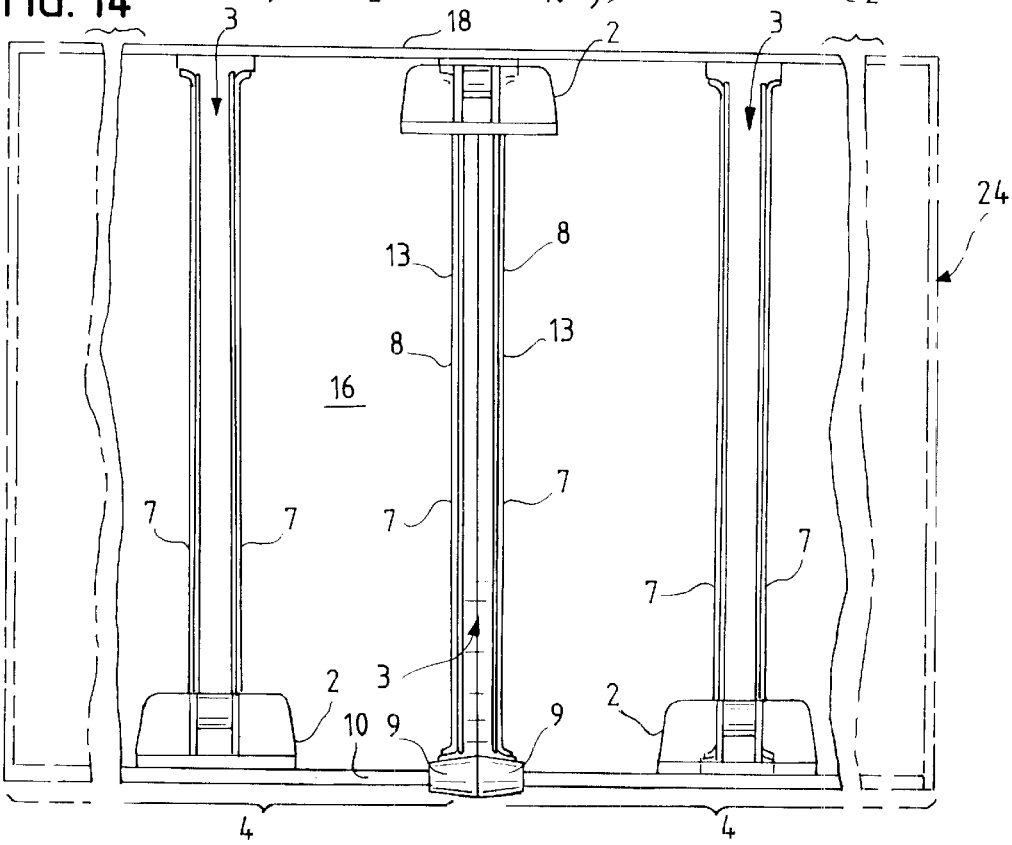
FIG. 14 is a fragmentary top plan view of the other preferred embodiment of the display and holding device of the present invention showing said one of a plurality of primary bays having been transformed when the adjacent side walls were laterally moved together to immobilize the object advancer of said one of a plurality of primary bays.

As best shown in FIGS. 13–14 of the drawing, the present invention provides a display and holding device comprising a plurality of primary bays 1 and a plurality of object advancers 2 equal in number to the number of the plurality of primary bays. One of the plurality of object advancers 2 is disposed in each of the plurality of primary bays.

Each of the plurality of primary bays is defined by a portion of a front wall 10, a first side wall 12 and a second side wall 14, a portion of a bottom wall 16, and a portion of a back wall 18. The front wall is parallel to the back wall. The front wall further has a bottom edge connected to a front edge of the bottom wall. The bottom wall further has a back edge connected to a bottom edge of the back wall, and each of the side walls is perpendicular to and extending from the front wall.

Each of the plurality of object advancers 2 is moveable along a path 3 between a forward position proximate to the front wall and an aft position proximate to the back wall. At least one of the first side wall 12 and the second side wall 14 is selectively moveable laterally between a primary position, shown in FIG. 13, in which the selectively moveable at least one of the first side wall and the second side wall is disposed between two adjacent paths 3 and a secondary position, shown in FIG. 14, in which the selectively moveable at least one of the first side wall 12 and the second side wall 14 is disposed along one of the two adjacent paths 3 while the object advancer 2 aligned in the one of the two adjacent paths is disposed in the aft position.

In this way, as the object advancer 2 aligned in the one of the two adjacent paths 3 is disposed proximate to the aft position and the selectively moveable at least one of the first side wall and the second side wall is moved to the secondary position in line with the one of the two adjacent paths, as shown in FIG. 14, the forward movement of the object advancer aligned in the one of the adjacent paths is secured in an immobile position proximate the back wall 18 by the selectively moveable at least one of the first side wall and the second side wall disposed in the secondary position.

Without departing from the generality of the invention disclosed herein and without limiting the scope of the invention, the discussion that follows will refer to the preferred embodiments of the invention as depicted in the drawing.

The preferred embodiments of the apparatus depicted in the drawing comprise a first side wall 12 and a second side wall 14 of two adjacent primary bays 1. As shown in FIGS. 1–3, 11, 13 and 18, one of the first side wall 12 and the second side wall 14 is the other of the first side wall 12 and the second side wall 14 of the other of the two adjacent primary bays 1.

Figures 15, 16, 17:
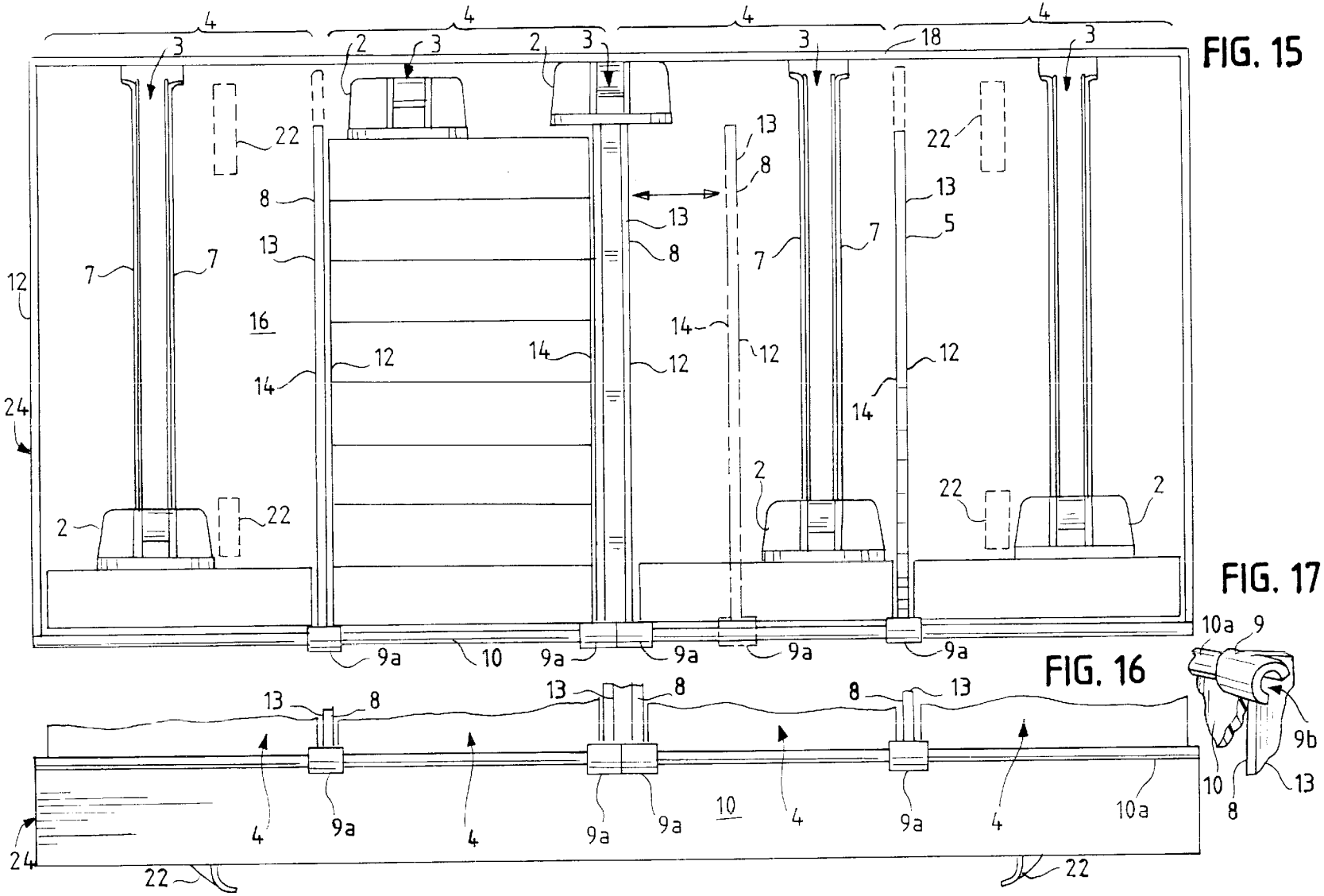
FIG. 15 is a top plan view of a third preferred embodiment of the display and holding device of the present invention showing an elongated cylindrical tube segment medially connected to front end of the divider and extending laterally in both directions, with one of the central dividers shown in phantom out of alignment with the central path to show that only one of the dividers is necessary to keep an object advancer in an immobile position proximate to the back wall, and showing all of the dividers having abbreviated lengths for greater arrangement versatility.
FIG. 16 is a frontal perspective view of the third preferred embodiment of the display and holding device of the present invention showing the proximity of the dividers having the tube segment medially connected to front end of the divider that extend laterally in both directions when mover together, and further showing two of a plurality of flanges extending from the bottom surface for use in stabilizing the display and holding device to a shelving unit.
FIG. 17 is a fragmentary detailed perspective view of the elongated cylindrical tube segment with a downward opening extending along the length of the tube segment disposed proximate to an upper edge of the divider which is arranged so that the downward opening slidably fits on to a beaded top edge of the front wall.
Figure 18:
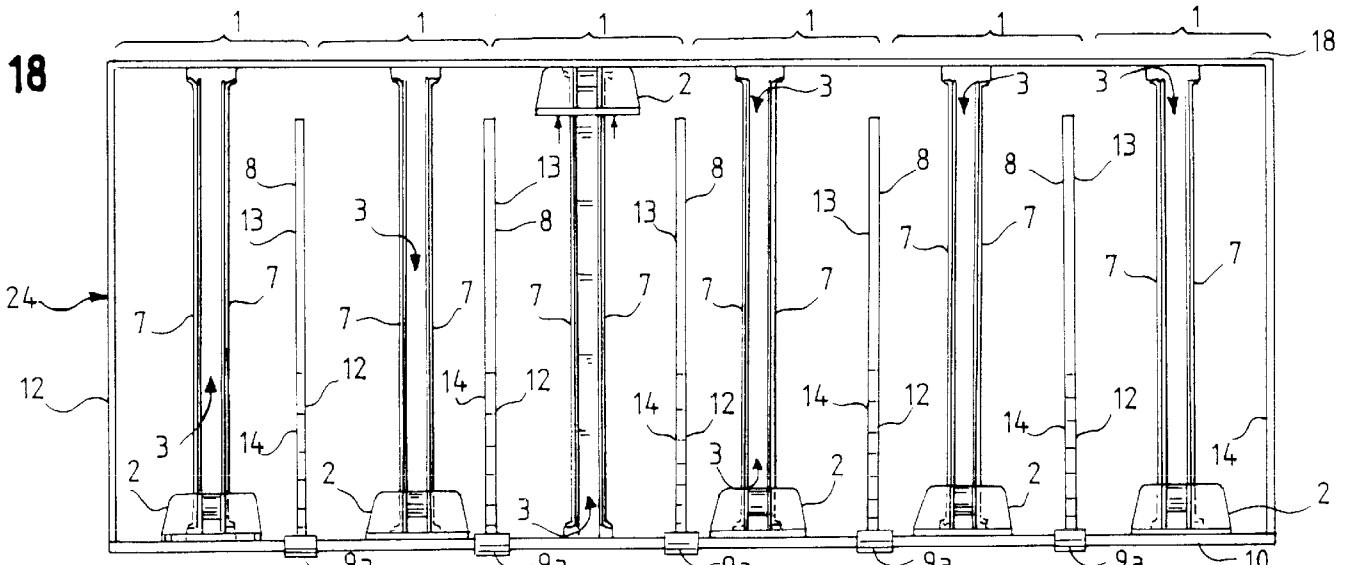
FIG. 18 is a top plan view of a fourth preferred embodiment of the display and holding device of the present invention showing all of the dividers with abbreviated lengths and with elongated cylindrical tube segment medially connected to front end of the divider which extend laterally in both directions.
Figure 19:
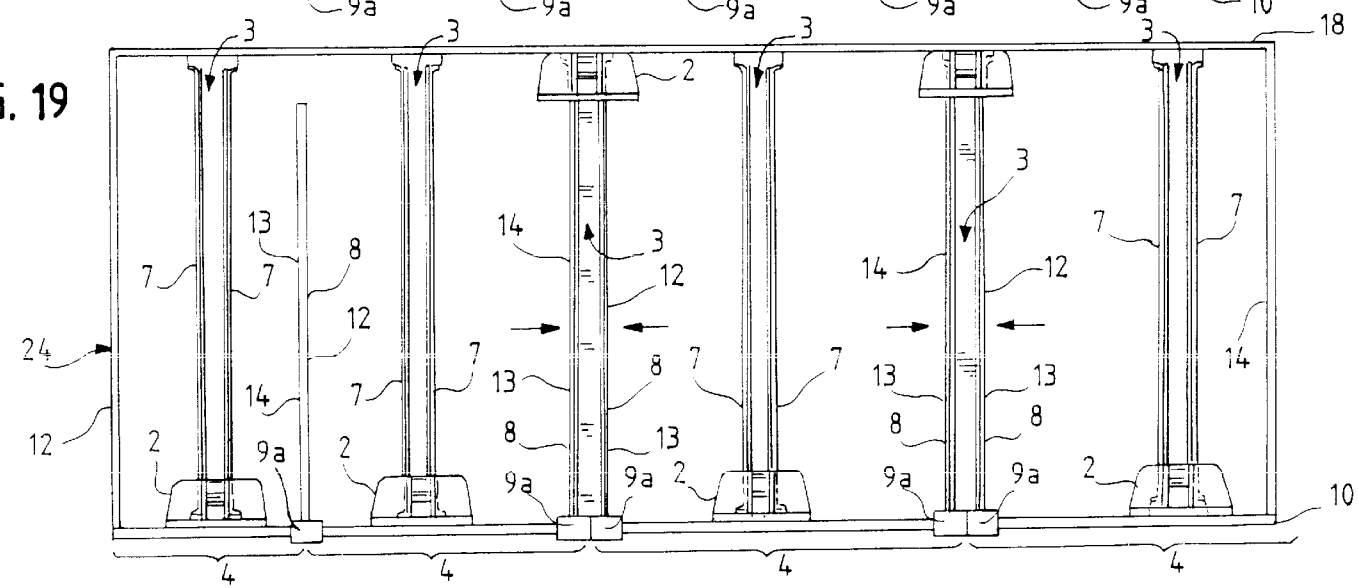
FIG. 19 is a top plan view of the third preferred embodiment of FIG. 18 showing a plurality of primary bays having been transformed when the object advancer of each of the primary bays is disposed in an aft position and the respective side walls of each of said transformed plurality of primary bays has been moved laterally together to immobilize said object advancers.

Preferably, at least one of the first side wall 12 and the second side wall 14 of each primary bay 1 is selectively moveable laterally between an initial position in which the selectively moveable at least one of the first side wall and the second side wall is disposed proximate an adjacent path and a secondary position in which the selectively moveable at least one of the first side wall and the second side wall is disposed along the adjacent path while the object advancer 2 aligned in the adjacent path is disposed proximate to the aft position. From this movement, the display and holding device is transformed from a primary configuration with a number of primary bays 1 to a secondary configuration with a reduced number of secondary bays 4. The secondary configuration can accommodate secondary objects of varying lateral dimensions, as best shown in FIGS. 15 and 19.

Figure 1:
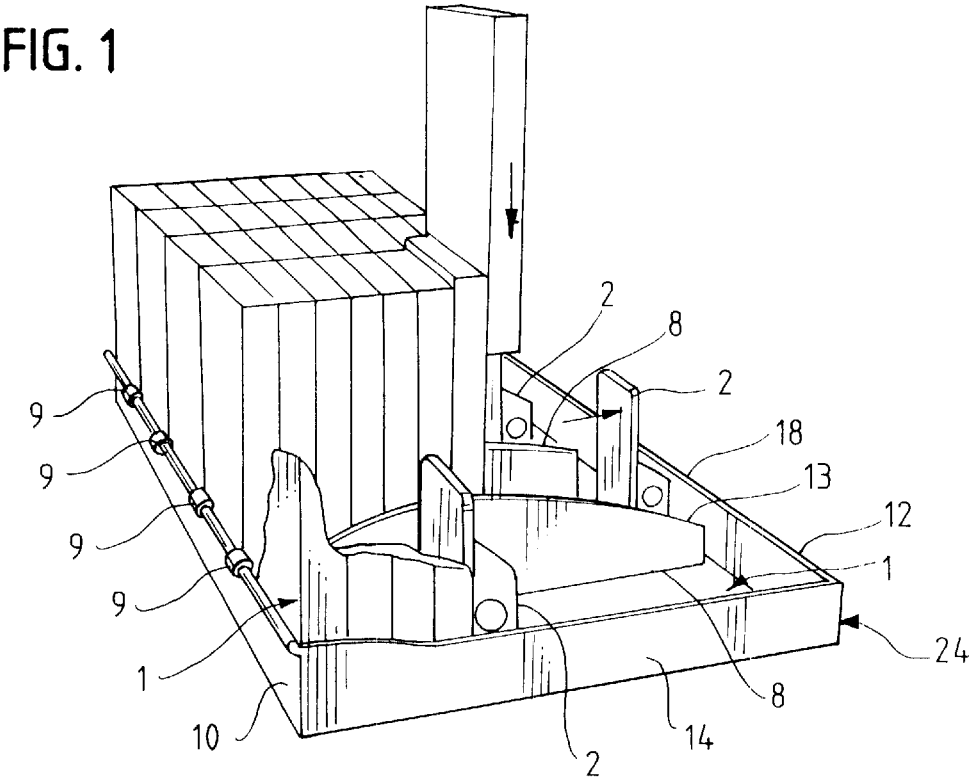
FIG. 1 is a partially cut-away perspective view of a preferred embodiment of the display and holding device of the present invention showing the arrangement of the object advancers as the device is being loaded with display items.
Figure 2:
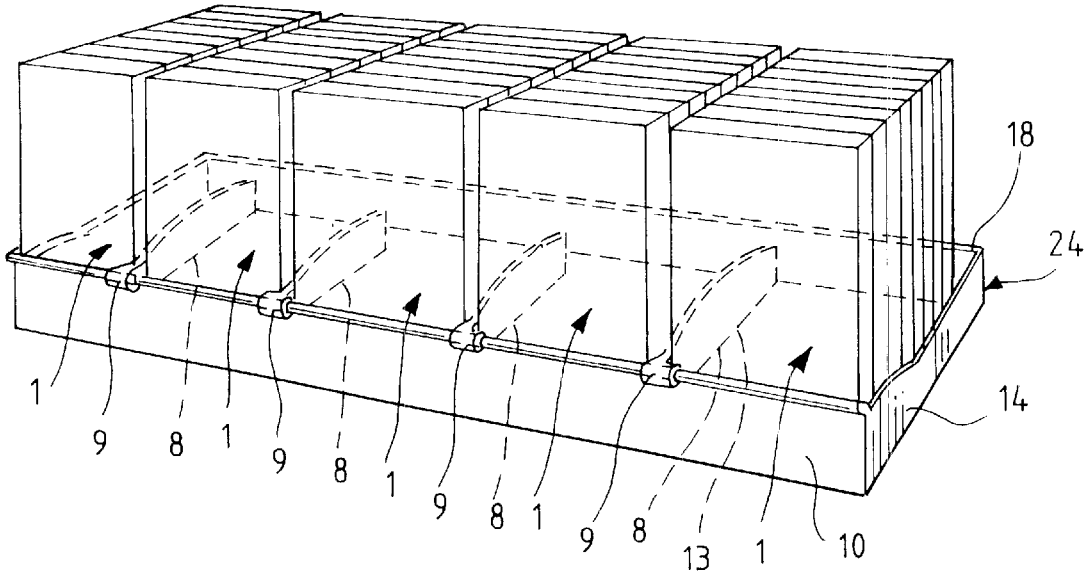
FIG. 2 is a perspective view of a preferred embodiment of the display and holding device of the present invention showing a plurality of primary bays separated by side walls.
Figure 3:
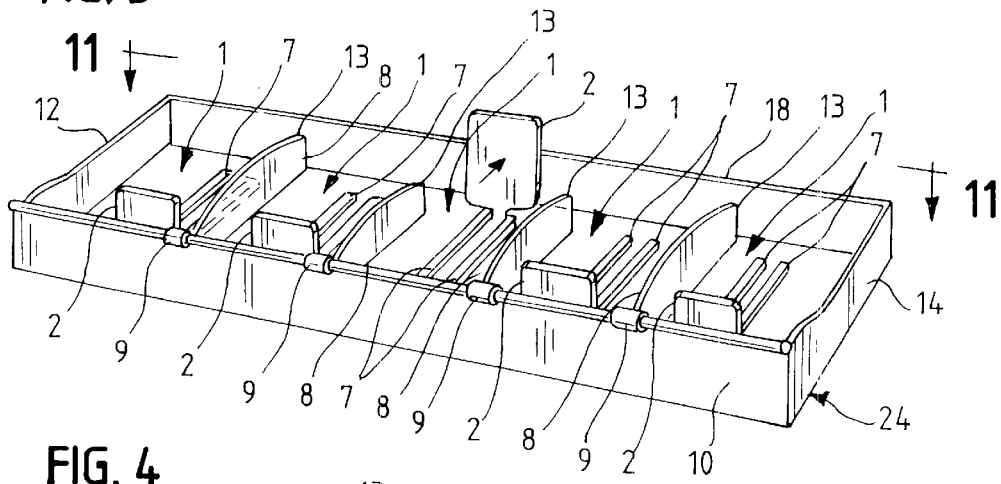
FIG. 3 is a perspective view of the preferred embodiment of the display and holding device of the present invention of FIG. 2 showing a central object advancer disposed proximate a back wall and the remaining object advancers biased toward a front wall.
Figure 4:
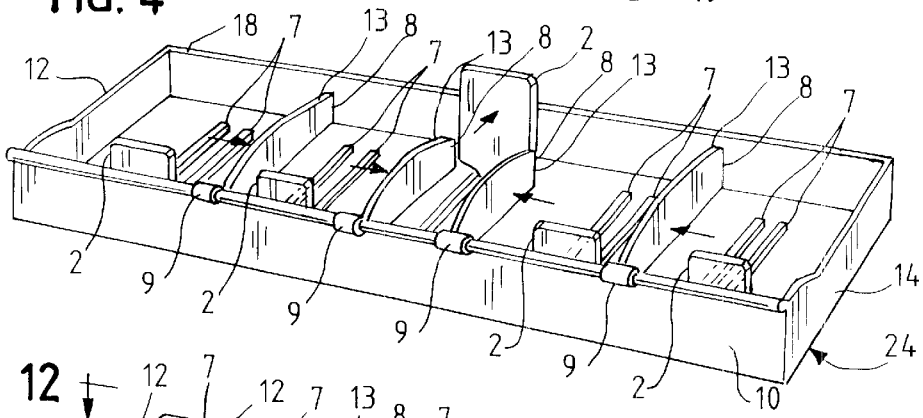
FIG. 4 is a perspective view of the preferred embodiment of the display and holding device of the present invention of FIG. 3 showing a first side wall and a second side wall of the central primary bay being moved laterally toward the path of the central bay and with the remaining selectively moveable sidewalls being moved laterally.
Figure 5:
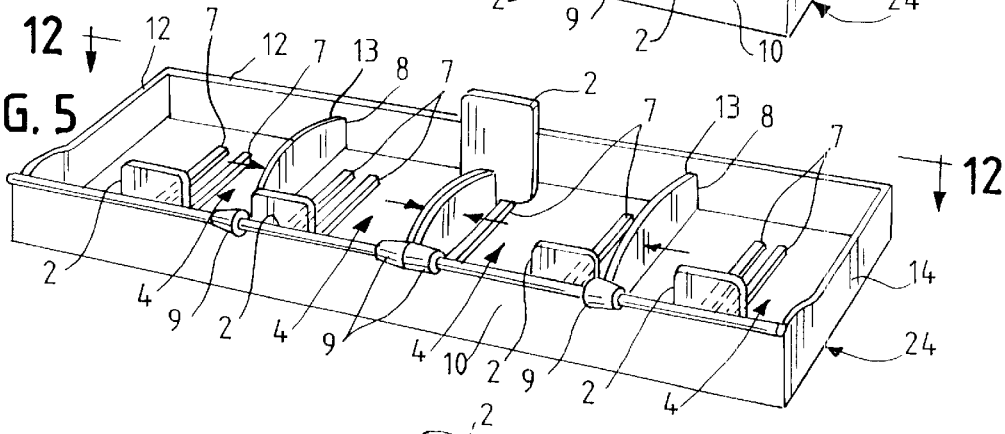
FIG. 5 is a perspective view of the preferred embodiment of the display and holding device of the present invention of FIG. 4 showing the first side wall and the second side wall of the central primary bay disposed along the path of the central bay and with the remaining selectively moveable side walls being moved laterally so that the distance between the separated side walls is uniform creating a reduced number of secondary bays of larger width.
Figure 6:
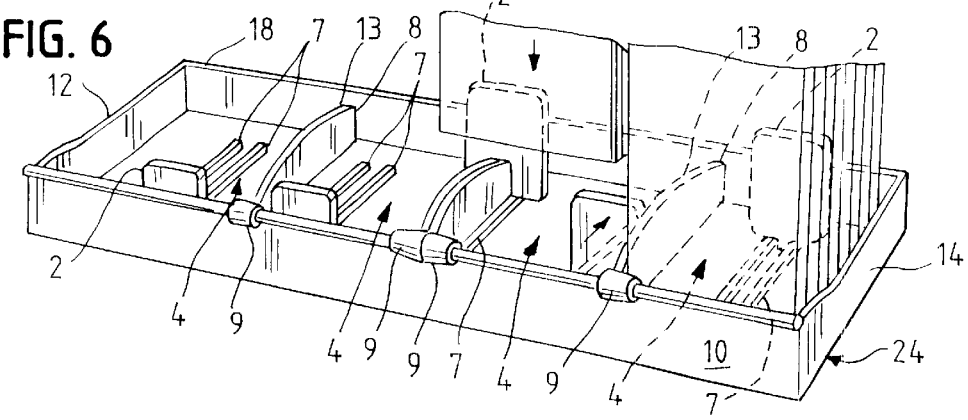
FIG. 6 is a perspective view of the preferred embodiment of the display and holding device of the present invention of FIG. 5 showing the arrangement of the object advancers as the secondary bays of the device are being loaded with display items.
Figure 7:
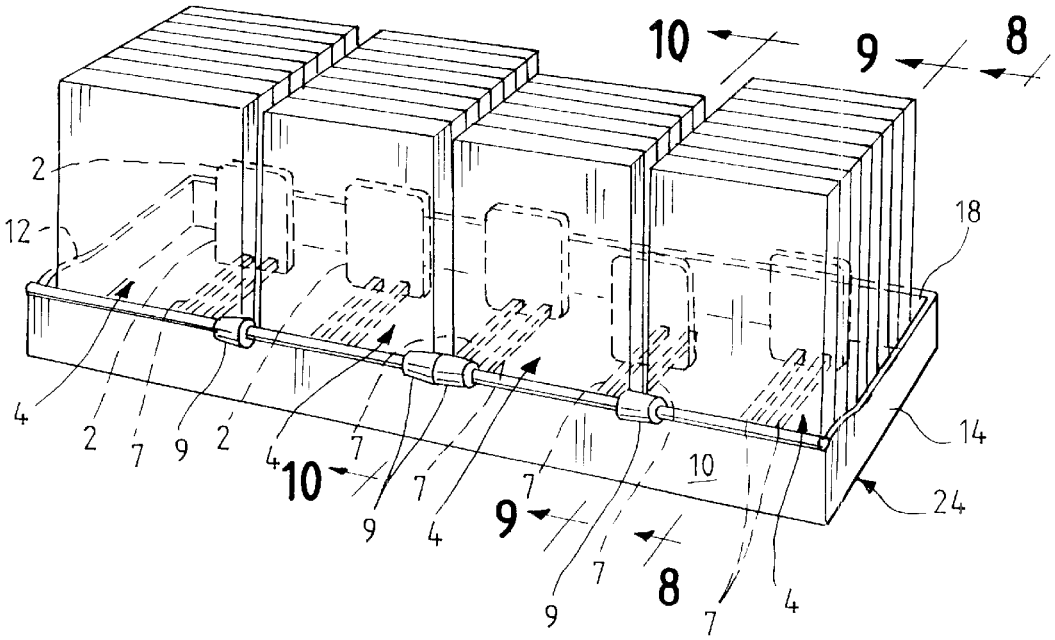
FIG. 7 is a perspective view of the preferred embodiment of the display and holding device of the present invention of FIG. 6 showing the arrangement of the object advancers as the secondary bays of the device are partially loaded with display items.

As best shown in FIGS. 5–7, preferable at least one of the first side wall 12 and the second side wall 14 of each primary bay 1 with an unsecured object advancer (those free to advance an object) can be selectively moved laterally to a position in which the lateral distance between the first side wall and the second side wall of each bay is uniform. The lateral distance is measured parallel to the front wall 10. This allows the display and holding device to be transformed from a primary configuration, as shown in FIGS. 1–3, with a number of primary bays 1 to a secondary configuration, as shown in FIGS. 5–7, with a reduced number of secondary bays 4 which can accommodate secondary objects of greater lateral dimension than the object that could be accommodated by each primary bay, and with each of the secondary bays having an unsecured one of the plurality of object advancers 2 disposed in each of the number of secondary bays 4 to advance the secondary objects.

Without limiting the foregoing, one application of the foregoing invention is the display and storage of video and audio tapes, video software, CDs and Digital Video Discs (DVDs). The lateral width of the objects vary depending in part on the particular packaging of its supplier. It is one of the objects of this important invention to accommodate these variances in product and lateral width. For example, a CD box has a width of 5½", a Nintendo video software package has a width of 7", a Nintendo Gameboy video software package has a width of 4 15/15", a DVD Hard Shell Box has a width of 5⅜"; 5 9/16" for a DVD Paper Package; 4⅛" for a Video Paper Box; and 5½" for a Video Clam Shell. All of these can be accommodated and displayed in the instant invention.

In a preferred embodiment of the invention, the display and holding device has five primary bays, as best shown in FIGS. 1–3, and 11. A central bay is the primary bay 1 in the middle. Referring to FIGS. 3–7, the first side wall 12 and the second side wall 14 of the central bay are selectively moveable laterally from the primary position to the secondary position in which the first side wall 12 and the second side wall 14 are disposed along the path 3 of object advancer 2 of the central bay. (FIG. 5.) As the object advancer 2 of the central bay is disposed proximate the aft position (FIG. 3) and the first side wall 12 and the second side wall 14 of the central bay are selectively moved laterally to the secondary position (FIGS. 4–5), the forward movement of the object advancer 2 of the central bay is secured in an immobile position proximate the back wall 18 by the first side wall 12 and the second side wall 14 of the central bay disposed in the secondary position (FIGS. 5–6).

Figure 11:
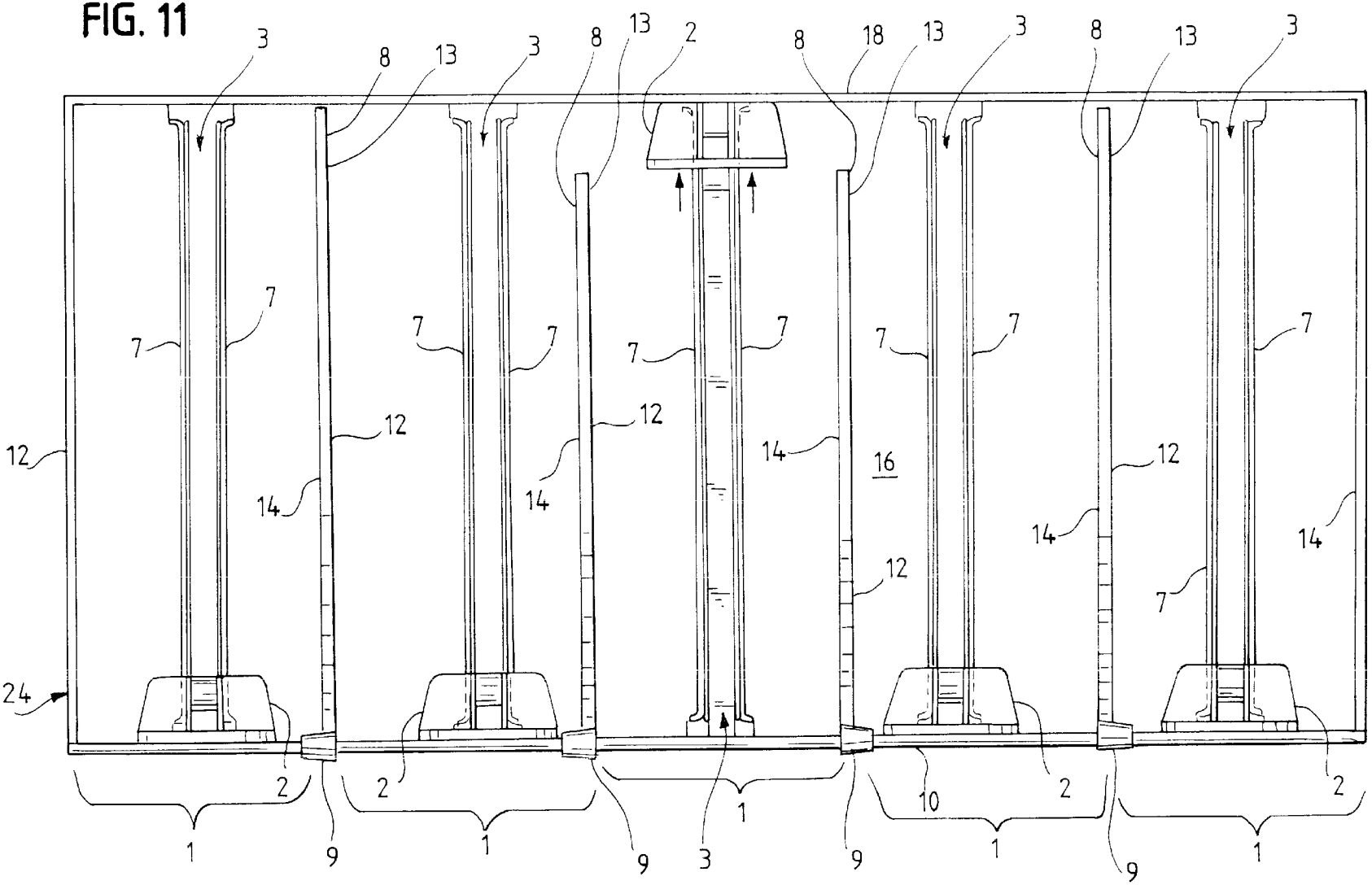
FIG. 11 is a top plan view taken along the line 11—11 of FIG. 3 showing the abbreviated length of the side walls adjacent the path of the central primary bay and the object advancer of the central primary bay disposed in an aft position.
Figure 12:
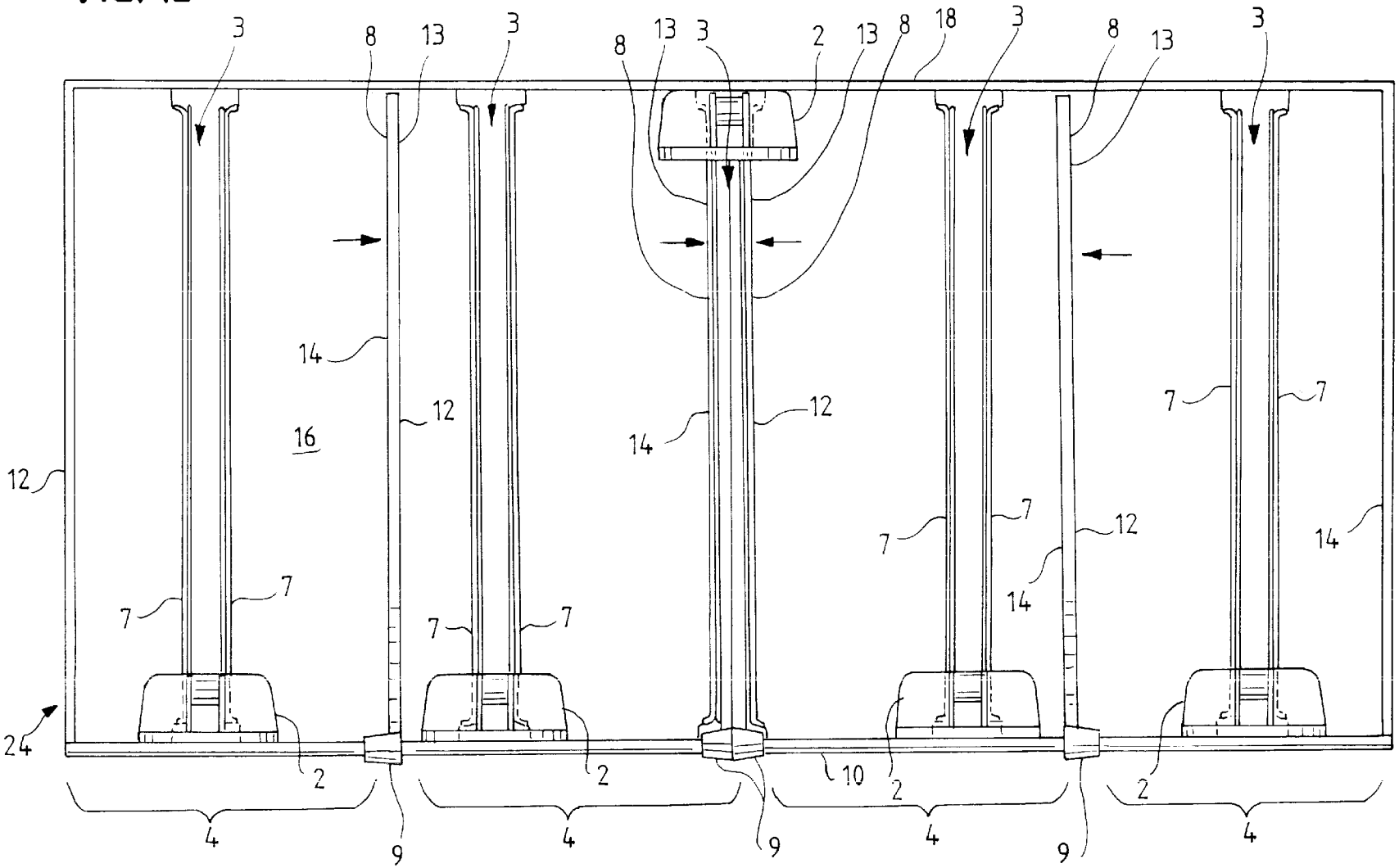
FIG. 12 is a top plan view taken along the line 12—12 of FIG. 5 showing the side walls that were adjacent the path of the central primary bay after they have been moved laterally along the path of the central primary bay and the object advancer of the central primary bay disposed in a position proximate the back wall.

In another preferred embodiment of the display and holding device of the present invention, at least one of the first side wall 12 and the second side wall 14 of each primary bay 1 with an unsecured object advancer 2 is selectively moveable laterally to a position in which the lateral distance between the first side wall and the second side wall of each bay is uniform, as shown in FIGS. 7 and 12. The display and holding device is transformed from a primary configuration having five primary bays (FIG. 11) to a secondary configuration having four secondary bays (FIG. 12) which can accommodate secondary objects of greater lateral dimension than the object that could be accommodated by each primary bay 1, and with each of the secondary bays 4 having an unsecured one of the plurality of object advancers 2 disposed in each of the number of secondary bays 4 to advance the secondary objects.

Figure 8:
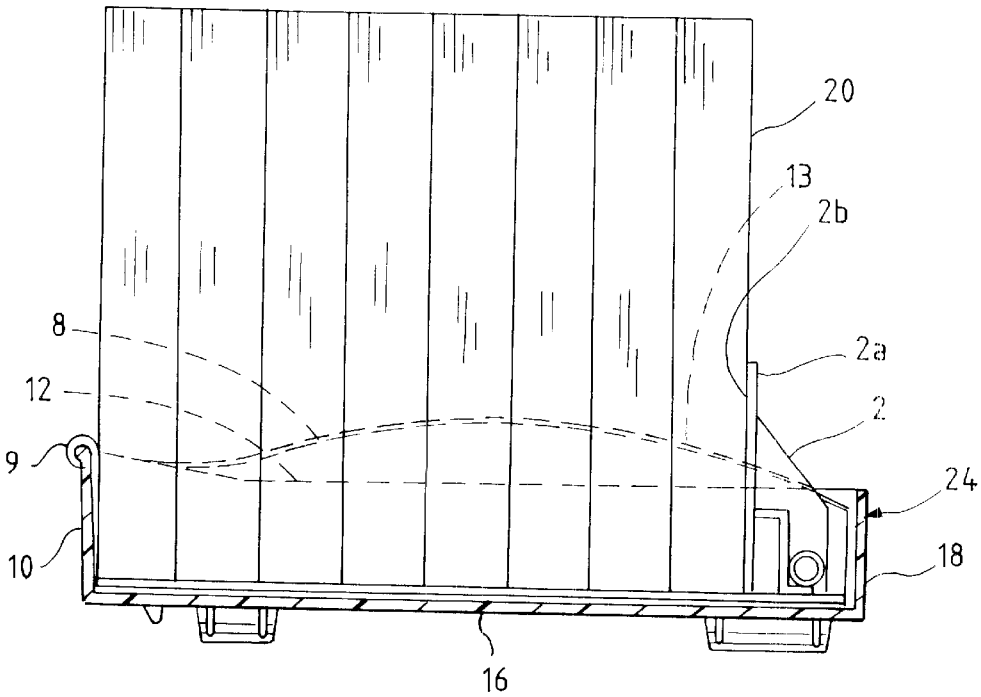
FIG. 8 is a section view taken along the line 8—8 of FIG. 7 showing one of the secondary bays filled with display objects and the position of the object advancer.
Figure 20:
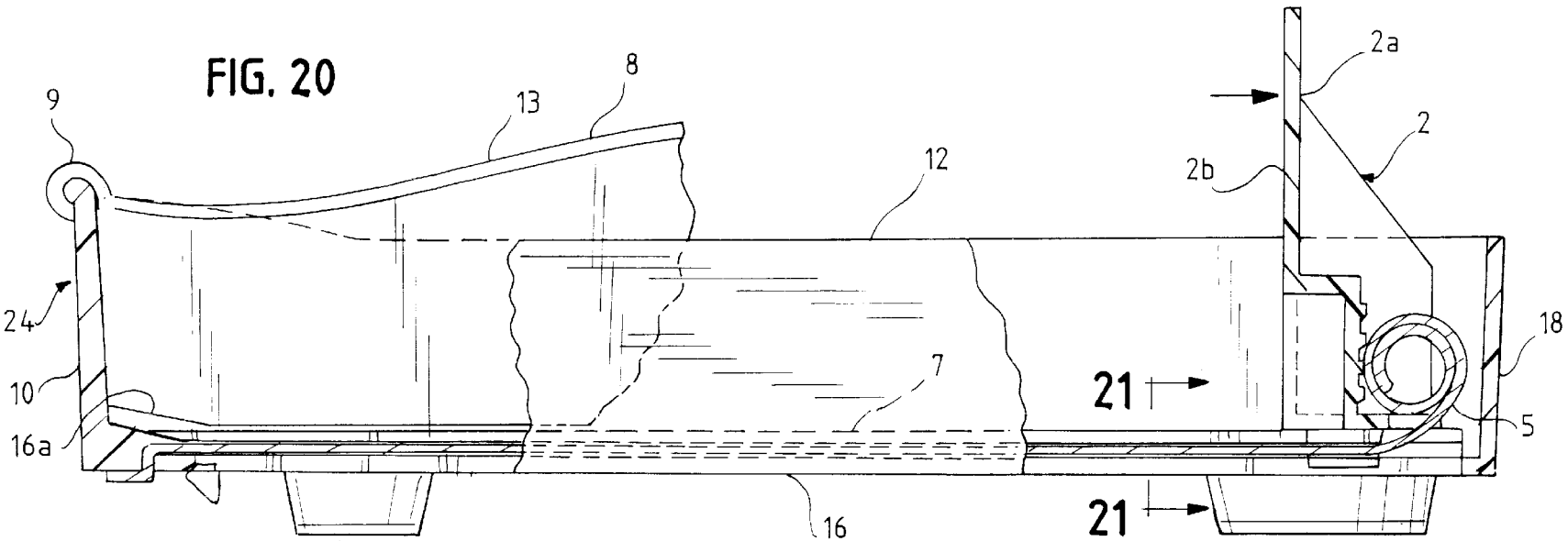
FIG. 20 is section view of the display and holding device of the present invention taken along the line 20—20 of FIG. 18 showing the object advancer as a spring biased hand having a coil spring which extends along a portion of the bottom wall disposed along the path of a bay as the hand is moved in to the aft position.
Figure 21:
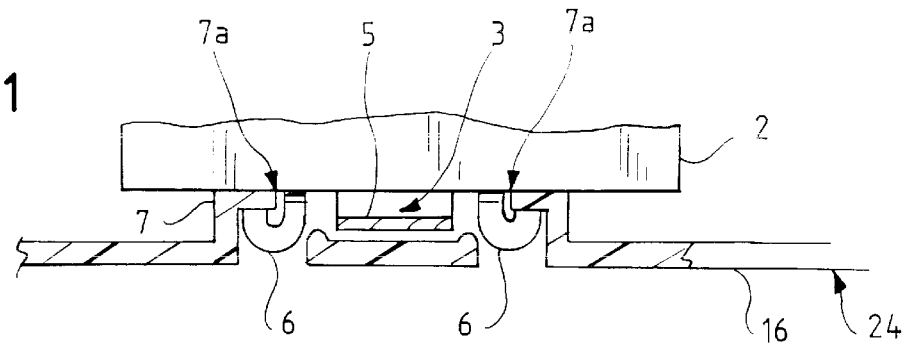
FIG. 21 is a section view taken along the line 21—21 of FIG. 20 showing one way of slidably securing the spring biased hand to the unit wherein the spring biased hand has a pair of upturned legs that extend through the bottom wall to secure the forward and back movement of the hand to the bottom wall which has a pair of elongated tracks to accommodate the legs of the hand with the tracks each having an integral elongated recess through which the legs are disposed.

Preferably, at least one of the plurality of object advancers 2 comprises a spring biased hand 2*a*, as best shown in FIGS. 8 and 20. The hand has a front face 2*b* for contact with a rear surface 20 of an object. In FIG. 20, it can be seen that the spring biased hand 2*a* has a coil spring 5 which extends along a portion of the bottom wall 16 disposed along the path 3 of a bay as the hand 2*a* is moved in to the aft position. One way of slidably securing the spring biased hand 2*a* to the unit is shown in FIG. 21. The spring biased hand 2*a* has a pair of upturned legs 6 that extend through the bottom wall 16 to secure the forward and back movement of the hand 2*a* to the bottom wall 16. The bottom wall has a pair of elongated tracks 7 to accommodate the legs 6 of the hand 2*a* of the object advancer 2. The tracks 7 each have an integral elongated recess 7*a* through which the legs 6 are disposed.

Another preferred feature is a ramp 16*a* consisting of a front portion of the bottom wall being sloped upwardly toward the front end to elevate at least one object disposed in front to facilitate removal. This feature is shown in FIG. 20.

Figure 9:
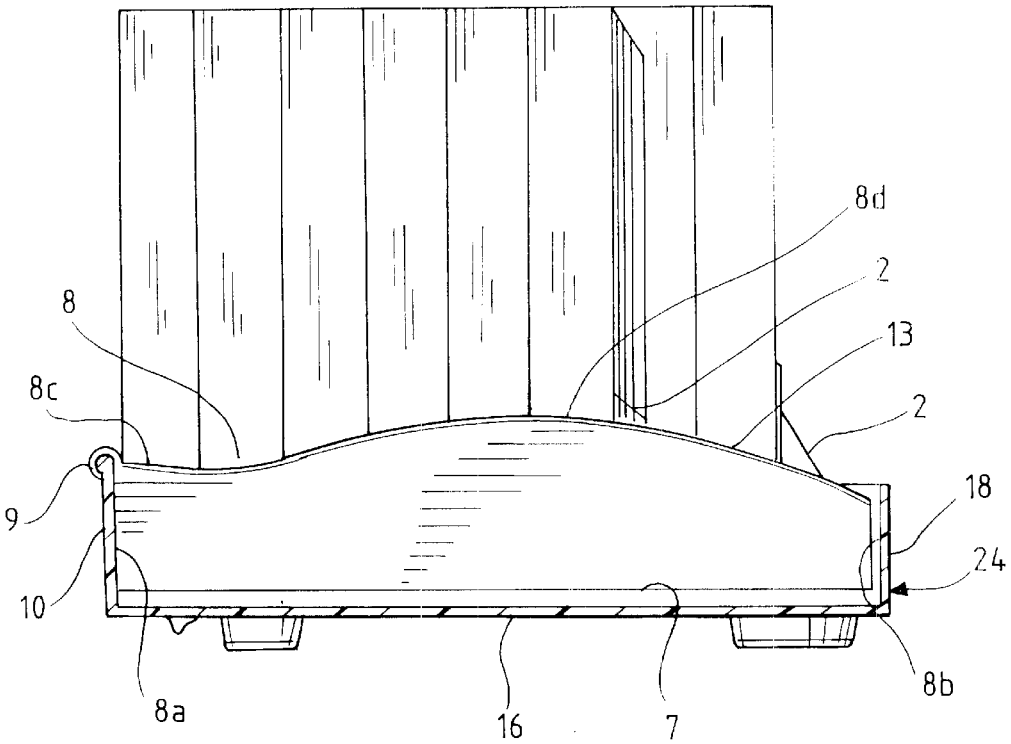
FIG. 9 is a section view taken along the line 9—9 of FIG. 7 showing an arched side wall (i.e. a divider or fin) separating the display objects disposed in adjacent secondary bays and the position of the respective object advancers biasing forward the objects each of the bays.
Figure 10:
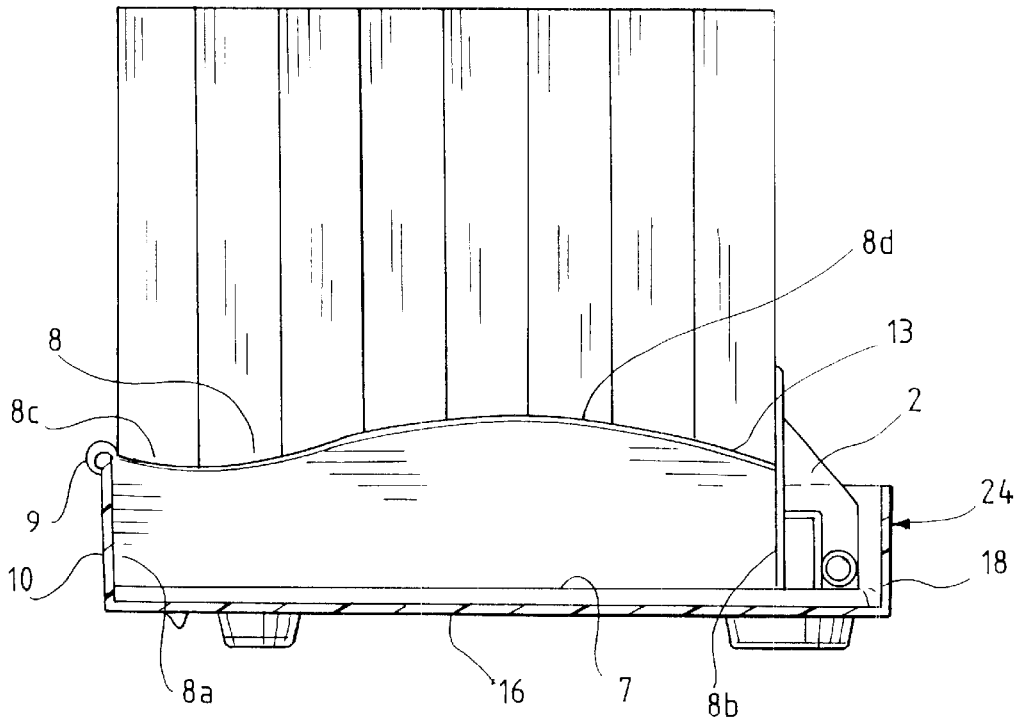
FIG. 10 is a section view taken along the line 10—10 of FIG. 7 showing particularly the abbreviated length of the central side walls (i.e. dividers or fins) which allows said side walls to be disposed in the path of the object advancer.

Preferably, the selectively moveable at least one of the first side wall 12 and the second side wall 14 of the present invention comprises a flat vertical elongated fin 8 having a front end 8*a* and a read end 8*b* (See FIG. 9.) The fin has an upper edge 8*c* with an arch 8*d*. The non-horizontal slope of the arched upper edge 8*c* of the fin 8 provides for easier insertion in to the device of the objects to be displayed therein.

Another preferred aspect of the display and holding device of the invention includes the front end 8*a* of the fin 8 having an elongated cylindrical tube segment 9 with a downward opening 9*b* extending along the length of the tube segment 9 disposed proximate to the upper edge 8*c*. As shown in FIG. 17, the tube segment 9 is aligned perpendicular to the flat vertical elongated fin 8 and arranged so that the downward opening 9*b* slidably fits on to a beaded top edge 10*a* of the front wall 10. The device may be made of a suitably rigid plastic with the tube segment 9 sufficiently resilient to allow it to snap onto the beaded top edge 10*a*. Alternatively, an end of the beaded top edge may be reduced in size to allow the downward opening 9*b* of the tube segment 9 to fit onto the reduced end 10*b*, as shown in FIG. 16.

In one preferred embodiment of the display and holding device, as shown in FIG. 11, a predetermined number of the flat vertical elongated fins 8 have a longitudinal dimension which is greater than the distance between an object advancer disposed in the aft position and the front wall. This, of course, limits the number of object advancers 2 that can be secured.

Another preferred aspect of the display and holding device is shown in FIG. 16, wherein the bottom wall 16 has a bottom surface with a plurality of flanges 22 extending from the bottom surface. The plurality of flanges 22 are adapted for use in stabilizing the display and holding device to a shelving unit.

Referring to FIGS. 22–25, another preferred embodiment of the display and holding device is shown with at least three primary bays 1 and at least three object advancers 2 equal in number to the number of the at least three primary bays are provided. One of the at least three object advancers is disposed in each of the at least three primary bays. Obviously, each bay could readily accommodate more than one object advancer. At least one object advancer is preferably desired for each bay, however, one skilled in the art would appreciate the more than one advancing means in each bay may be employed.

Each of the at least three primary bays is defined by a portion of a front wall, a first side wall and a second side wall, a portion of a bottom wall, and a portion of a back wall. The front wall is parallel to the back wall, the front wall further has a bottom edge connected to a front edge of the bottom wall, the bottom wall further has a back edge connected to a bottom edge of the back wall, and each of the side walls is perpendicular to and extending from the front wall. Each of the at least three object advancers is moveable along a path between a forward position proximate to the front wall and an aft position proximate to the back wall.

Figure 22:
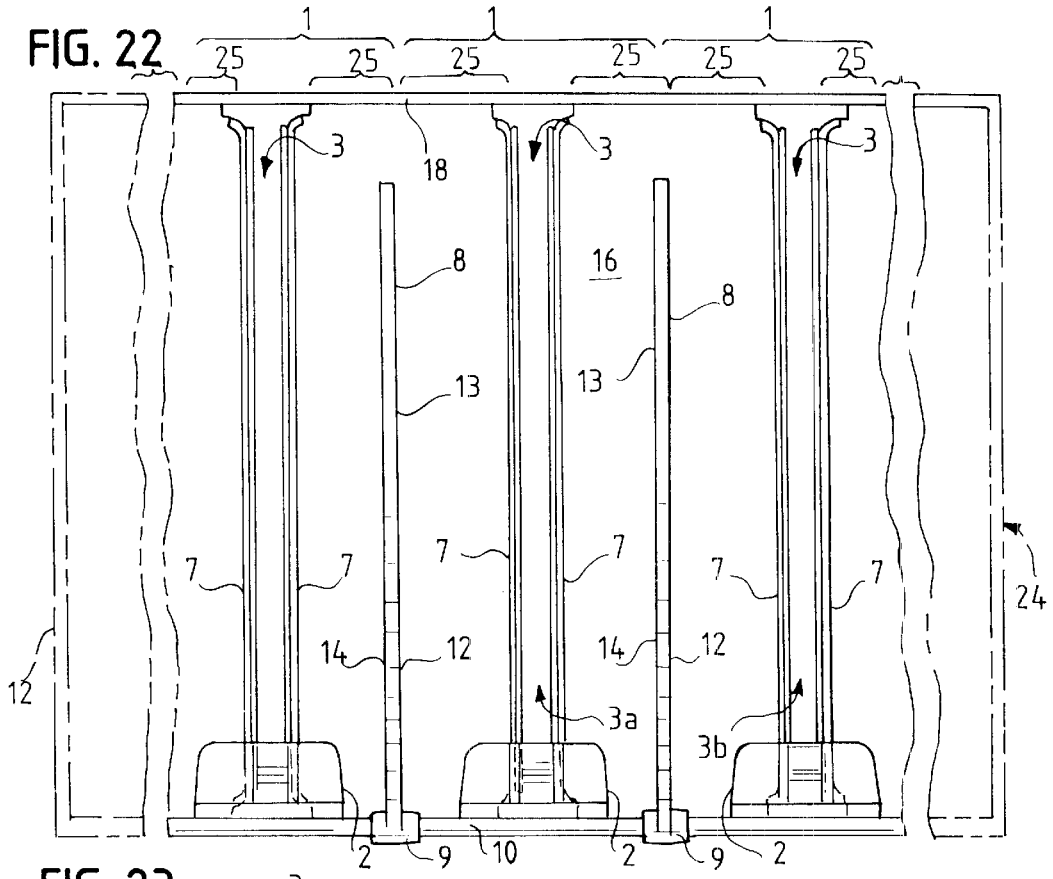
FIGS. 22–25 each show a fragmentary top plan view of the present invention.

In this preferred embodiment, at least one of the first side wall 12 and the second side wall 14 is selectively moveable laterally between a primary position, shown in FIG. 22, in which the selectively moveable at least one of the first side wall and the second side wall is disposed between a first path 3*a* and a second path 3*b*, the first path is adjacent to the second path, and the selectively moveable at least one of the first side wall 12 and the second side wall 14 have a length that does not substantially exceed the distance between the front wall 10 and an object advancer 2 disposed in the aft position, and a secondary position.

In the secondary position, the selectively moveable at least one of the first side wall and the second side wall is disposed along one of i) the path 3 of one of the at least three object advancers while the object advancer 2 aligned in the path is disposed in the aft position, and ii) a corridor 25 independent of immediate proximity to both the first path 3*a* and the second path 3*b*. Each corridor 25 is adjacent and parallel to one of the paths 3 and extends between the front wall 10 and the back wall 18.

Figure 23:
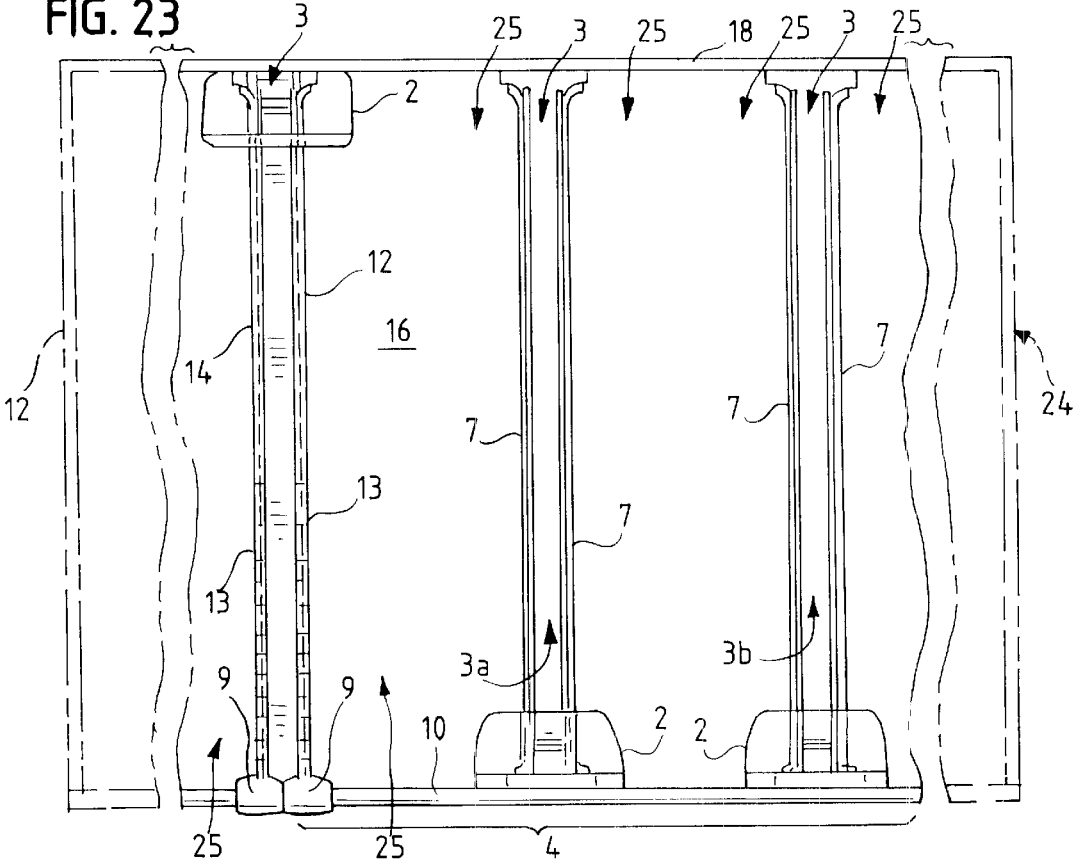
Figure 24:
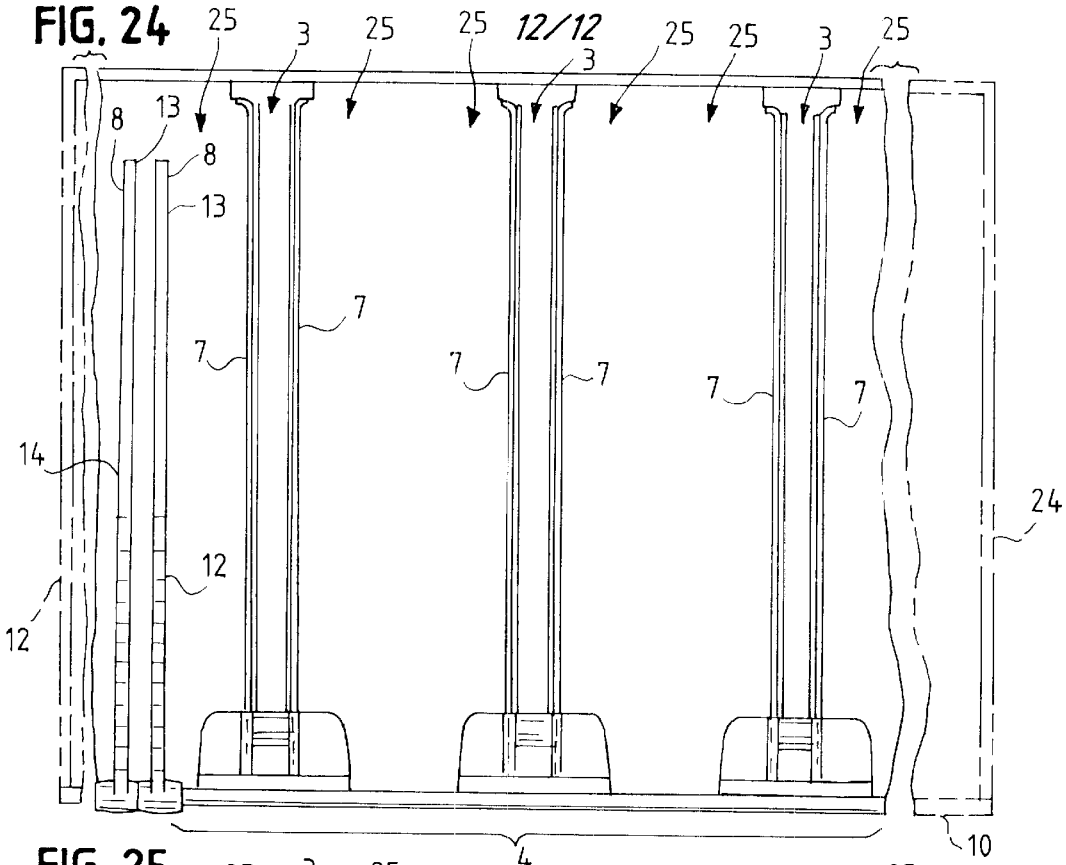
Figure 25:
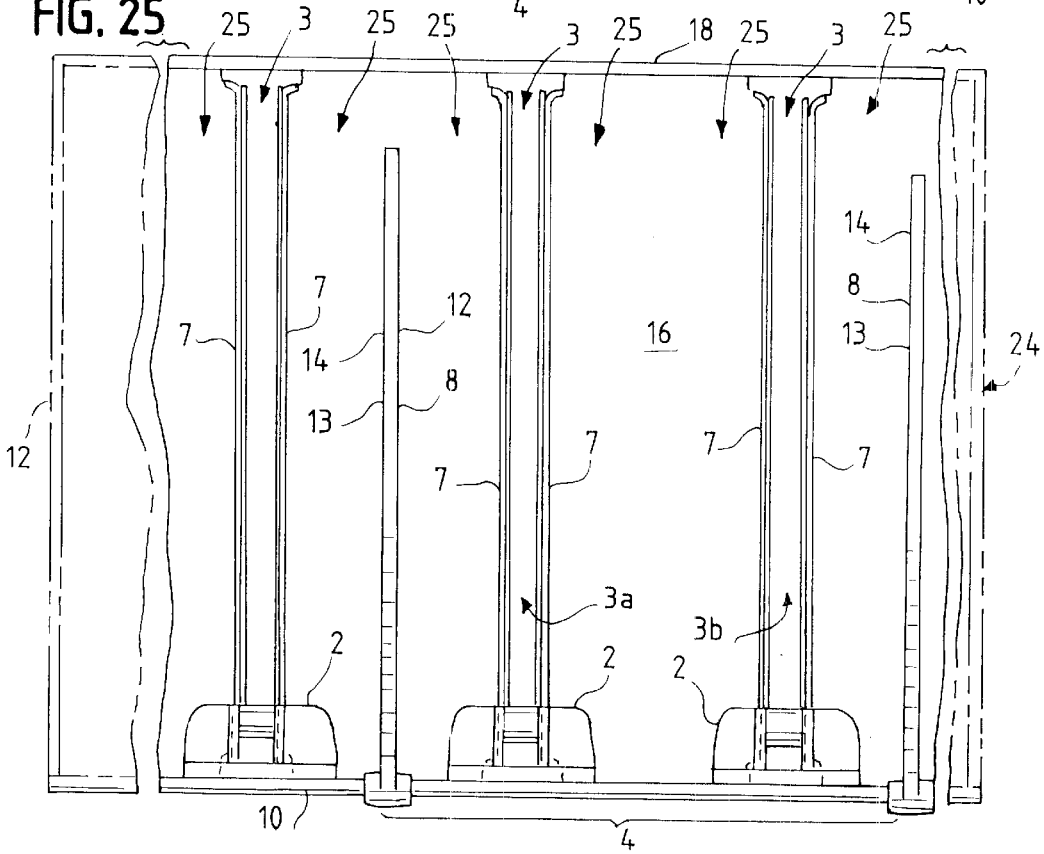

In this way, when at least one of the selectively moveable at least one of the first side wall 12 and the second side wall 14 is disposed in the secondary position, as shown in FIGS. 23–25, the display and holding device is transformed from a primary configuration, as shown in FIG. 22, having at least three primary bays to a secondary configuration having a reduced number of secondary bays with at least one of the secondary bays having a plurality of object advancers disposed therein.

Preferably, each of the selectively moveable at least one of the first side wall and the second side wall has a length that does not substantially exceed the distance between the front wall and an object advancer disposed in the aft position.

An improved display and holding tray 24 is taught by this invention. It is of the type, in which a tray, has a front wall 10, a pair of side walls (12,14), a bottom wall 16, and a back wall 18, with the front wall 10 being parallel to the back wall 18 and the pair of side walls (12,14) being parallel to each other (14,12), the front wall 10 has a top edge, a bottom edge connected to a front edge of the bottom wall, and two side edges, each of which is connected respectively to a front edge of each of the pair of side walls, the bottom wall further has a pair of side edges, each of which is connected respectively to a bottom edge of each of the pair of side walls, and a back edge connected to a bottom edge of the back wall.

The improvement comprises a predetermined number of object advancers 2 and a plurality of flat vertical elongated dividers 13 equal in number to one less than the predetermined number of object advancers 2. Each of the predetermined number of object advancers is moveable along a path 3 between a forward position proximate to the front wall 10 and an aft position proximate to the back wall 18. Each of the plurality of flat vertical elongated dividers 13 extends from the front wall 10 of the tray 24. Each of the plurality of flat vertical elongated dividers 13 is laterally moveable, with two of the plurality of flat vertical elongated dividers 13 laterally moveable from a primary position in which each of the two dividers straddles one of the paths to a secondary position in which the two dividers are disposed along the one of the paths 3 while the object advancer 2 aligned in the one of the paths 3 is disposed proximate to the aft position.

Whereby, as the object advancer 2 aligned in the one of the paths 3 is disposed proximate to the aft position and the two dividers 13 are moved to the secondary position in line with the one of the paths 3, the forward movement of the object advancer 2 aligned in the one of the paths 3 is secured in an immobile position proximate the back wall 18 by the two dividers 13 disposed in the secondary position.

Preferably, in the improved display and holding tray, each of the plurality of flat vertical elongated dividers 13 is selectively moveable laterally to a position in which the lateral distance between adjacent dividers is uniform, as shown in FIGS. 5–7. The display and holding tray is thus transformed from a primary configuration with a predetermined number of unrestricted object advancers to a secondary configuration with a reduced number of unrestricted object advancers 2.

Another preferred aspect of the improved display and holding tray provides a front end of each of the plurality of dividers 13 with an elongated cylindrical tube segment 9 with a downward opening 9*b* extending along the length of the tube segment 9 disposed proximate an upper edge. The elongated cylindrical tube segment is aligned perpendicular to the length of the divider 13 so that the downward opening 9*b* slidably fits onto the top edge 10*a* of the front wall 10. The elongated cylindrical tube segment 9 may extend to one side of the divider 13, as shown in FIGS. 11–12, or it may be medially connected to the front end of the divider and extends laterally in both directions, identified by number 9*a* as shown in FIGS. 15–16 and 18–19.

Preferably, the top edge 10*a* of the front wall is beaded and the downward opening 9*b* of the elongated cylindrical tube segment can be snapped onto the beaded top edge of the front wall, as best seen in FIG. 17. Alternatively, an end of the beaded top edge may be reduced in size to allow the downward opening 9*b* of the tube segment 9 to fit onto the reduced end 10*b*, as shown in FIG. 16.

As shown in FIG. 11, a predetermined number of the plurality of flat vertical elongated dividers have a longitudinal dimension which is greater than the distance between an object advancer disposed in the aft position and the front wall. Obviously, when a predetermined number of the plurality of flat vertical elongated dividers have a longitudinal dimension which is less than the distance between an object advancer disposed in the aft position and the front wall, a tray having greater versatility is provided.

An improved display and holding tray of the type is further embodied in the present invention, in which a tray 24, has a front wall, a pair of side walls, a bottom wall, and a back wall, with the front wall is parallel to the back wall and the pair of side walls is parallel to each other, the front wall having a top edge, a bottom edge connected to a front edge of the bottom wall, and two side edges, each of which is connected respectively to a front edge of each of the pair of side walls, the bottom wall further having a pair of side edges, each of which is connected respectively to a bottom edge of each of the pair of side walls, and a back edge connected a bottom edge of the back wall. The improvement comprises a predetermined number of object advancers 2 and a plurality of flat vertical elongated dividers 13 equal in number to one less than the predetermined number of object advancers 2.

Each of the plurality of flat vertical elongated dividers 13 extends from the front wall 10 of the tray. Each of the predetermined number of object advancers is moveable along a path 3 between a forward position proximate to the front wall and an aft position proximate to the back wall 18.

At least one of the dividers is laterally moveable from a primary position in which the at least one of the laterally moveable dividers is disposed between a first path 3a and a second path 3*b*. The first path is adjacent to the second path and the at least one of the laterally moveable dividers has a length that does not substantially exceed the distance between the front wall and an object advancer disposed in the aft position, and a secondary position, shown in FIGS. 23–25, in which the at least one of the laterally moveable dividers 13 is disposed along one of i) the path 3 of one of the predetermined number of object advancers 2 while the object advancer aligned in the path is disposed in the aft position (illustrated in FIG. 23), and ii) a corridor independent of immediate proximity to both the first path and the second path (illustrated in FIGS. 24–25).

Whereby, when at least one of the laterally moveable dividers is disposed in the secondary position, the improved display and holding tray is transformed from a primary configuration having a predetermined number of primary bays to a secondary configuration having a reduced number of secondary bays with at least one of the secondary bays having a plurality of object advancers disposed therein.

Preferably, each of the selectively moveable at least one of the first side wall and the second side wall has a length that does not substantially exceed the distance between the front wall and an object advancer disposed in the aft position.

Another preferred feature of the improved tray is a ramp 16*a* consisting of a front portion of the bottom wall being sloped upwardly toward the front end to elevate at least one object disposed in front to facilitate removal. This feature is shown in FIG. 20.

While this invention has been described in connection with the best mode presently contemplated by the inventor for carrying out his invention, the preferred embodiments described and shown are for purposes of illustration only, and are not to be construed as constituting any limitations of the invention. Modifications will be obvious to those skilled in the art, and all modifications that do not depart from the spirit of the invention are intended to be included within the scope of the appended claims.

My invention resides not in any one of these features per se, but rather in the particular combination of all of them herein disclosed and claimed and it is distinguished from the prior art in this particular combination of all of its structures for the function specified.

These together with other objects of the invention, along with the various features of novelty which characterize the invention are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A display and holding device comprising:

a. a plurality of primary bays, each of said plurality of primary bays being defined by a portion of a front wall, a first side wall and a second side wall, a portion of a bottom wall, and a portion of a back wall, said front wall being parallel to the back wall, said front wall further having a bottom edge connected to a front edge of the bottom wall, the bottom wall further having a back edge connected to a bottom edge of the back wall, and each of the side walls being perpendicular to and extending from the front wall; and b. a plurality of object advancers equal in number to the number of said plurality of primary bays, one of said plurality of object advancers being disposed in each of said plurality of primary bays, each of said plurality of object advancers being moveable along and aligned with a path extending between a forward position proximate to the front wall and an aft position proximate to the back wall, wherein, at least one of the first side wall and the second side wall is selectively moveable laterally between a primary position in which the selectively moveable at least one of the first side wall and the second side wall is disposed between two adjacent paths and a secondary position in which the selectively moveable at least one of the first side wall and the second side wall is disposed in a line parallel with the length of one of the two adjacent paths while the object advancer aligned with said one of the two adjacent paths is disposed in the aft position, whereby, as the object advancer aligned in said one of the two adjacent paths is disposed proximate to the aft position and the selectively moveable at least one of the first side wall and the second side wall is moved to the secondary position, the forward movement of the object advancer aligned in said one of the adjacent paths is secured in an immobile position proximate the back wall by said selectively moveable at least one of the first side wall and the second side wall disposed in the secondary position.

2. The display and holding device of claim 1, wherein at least one of the first side wall and the second side wall of each primary bay is selectively moveable laterally between an initial position in which the selectively moveable at least one of the first side wall and the second side wall is disposed proximate an adjacent path and a secondary position in which the selectively moveable at least one of the first side wall and the second side wall is disposed along said adjacent path while the object advancer aligned in said adjacent path is disposed proximate to the aft position, whereby, the display and holding device is transformed from a primary configuration having a number of primary bays to a secondary configuration having a reduced number of secondary bays which can accommodate secondary objects of varying lateral dimensions.

3. The display and holding device of claim 1, wherein at least one of the first side wall and the second side wall of each primary bay with an unsecured object advancer is selectively moveable laterally to a position in which the lateral distance between the first side wall and the second side wall of each bay is uniform, and the display and holding device is transformed from a primary configuration having a number of primary bays to a secondary configuration having a reduced number of secondary bays which can accommodate secondary objects of greater lateral dimension than the object that could be accommodated by each primary bay, and with each of the secondary bays having an unsecured one of said plurality of object advancers being disposed in each of said number of secondary bays to advance the secondary objects.

4. The display and holding device of claim 1, wherein the plurality of primary bays comprises five primary bays with a central bay being the primary bay in the middle, and wherein the first side wall and the second side wall of the central bay are selectively moveable laterally from the primary position to the secondary position in which the first side wall and the second side wall are disposed along the path of the object advancer of the central bay, whereby, as the object advancer of the central bay is disposed proximate the aft position and the first side wall and the second side wall of the central bay are selectively moved laterally to the secondary position, the forward movement of the object advancer of the central bay is secured in an immobile position proximate the back wall by the first side wall and the second side wall of the central bay disposed in the secondary position.

5. The display and holding device of claim 4, wherein at least one of the first side wall and the second side wall of each primary bay with an unsecured object advancer is selectively moveable laterally to a position in which the lateral distance between the first side wall and the second side wall of each bay is uniform, whereby, the display and holding device is transformed from a primary configuration having five primary bays to a secondary configuration having four secondary bays which can accommodate secondary objects of greater lateral dimension than the object that could be accommodated by each primary bay, and with each of the secondary bays having an unsecured one of said plurality of object advancers being disposed in each of said number of secondary bays to advance the secondary objects.

6. The display and holding device of claim 1, wherein at least one of the plurality of object advancers comprises a spring biased hand, said hand having a front face for contact with a rear surface of an object.

7. The display and holding device of claim 6, wherein said spring biased hand has a coil spring which extends along a portion of the bottom wall disposed along the path of a bay as the hand is moved to the aft position.

8. The display and holding device of claim 1, wherein the selectively moveable at least one of the first side wall and the second side wall comprises a flat vertical elongated fin having a front end and a rear end.

9. The display and holding device of claim 8, wherein the fin has an upper edge with an arch.

10. The display and holding device of claim 8, wherein the front end of the fin has an elongated cylindrical tube segment with a downward opening extending along the length of the tube segment disposed proximate to an upper edge, said tube segment is aligned perpendicular to the flat vertical elongated fin and arranged so that the downward opening slidably fits on to a beaded top edge of the front wall.

11. The display and holding device of claim 8, wherein a predetermined number of the flat vertical elongated fins have a longitudinal dimension which is greater than the distance between an object advancer disposed in the aft position and the front wall.

12. The display and holding device of claim 1, wherein the bottom wall has a bottom surface with a plurality of flanges extending from said bottom surface, said plurality of flanges are adapted for use in stabilizing the display and holding device with respect to a shelving unit.

13. The display and holding device of claim 1, wherein a front portion of the bottom wall is sloped upwardly toward the front to elevate at least one object disposed in front to facilitate removal.

14. A display and holding tray assembly, in which a tray, has a front wall, a pair of side walls, a bottom wall, and a back wall, with the front wall being parallel to the back wall and the pair of side walls being parallel to each other, said front wall having a top edge, a bottom edge connected to a front edge of the bottom wall, and two side edges, each of which is connected respectively to a front edge of each of the pair of side walls, said bottom wall further having a pair of side edges, each of which is connected respectively to a bottom edge of each of the pair of side walls, and a back edge connected a bottom edge of the back wall, wherein the improvement comprises:

a. a predetermined number of object advancers, each of said predetermined number of object advancers being moveable along and aligned with a path extending between a forward position proximate to the front wall and an aft position proximate to the back wall; and b. a plurality of flat vertical elongated dividers equal in number to one less than the predetermined number of object advancers, each of said plurality of flat vertical elongated dividers extends from the front wall of the tray, each of said plurality of flat vertical elongated dividers being laterally moveable, with two of said plurality of flat vertical elongated dividers being laterally moveable from a primary position in which each of said two dividers straddles one of the paths to a secondary position in which said two dividers are disposed in a line parallel with the length of said one of the paths while the object advancer aligned in said one of the paths is disposed proximate to the aft position, whereby, as the object advancer aligned with said one of the paths is disposed proximate to the aft position and said two dividers are moved to the secondary position in line with said one of the paths, the forward movement of the object advancer aligned with said one of the paths is secured in an immobile position proximate the back wall by said two dividers disposed in the secondary position.

15. The display and holding tray assembly of claim 14, wherein each of said plurality of flat vertical elongated dividers is selectively moveable laterally to a position in which the lateral distance between adjacent dividers is uniform, and the display and holding tray is transformed from a primary configuration having a predetermined number of object advancers disposed in the primary position to a secondary configuration having a reduced number of object advancers disposed in the primary position, said object advancers disposed in the primary position being free to move along the path between the forward position proximate to the front wall and the aft position proximate to the back wall independent of obstruction from any of said plurality of flat vertical elongated dividers.

16. The display and holding tray assembly of claim 14, wherein a front end of each of the plurality of dividers has an elongated cylindrical tube segment with a downward opening extending along the length of the tube segment disposed proximate an upper edge, said elongated cylindrical tube segment is aligned perpendicular to the length of the divider so that the downward opening slidably fits onto the top edge of the front wall.

17. The display and holding tray assembly of claim 16, wherein the elongated cylindrical tube segment extends to one side of the divider.

18. The display and holding tray assembly of claim 16, wherein the elongated cylindrical tube segment is medially connected to the front end of the divider and extends laterally in both directions.

19. The display and holding tray assembly of claim 14, wherein the top edge of the front wall is beaded with an end of the beaded top edge having a reduced size to allow a downward opening of the elongated cylindrical tube segment to fit onto the reduced end of the beaded top edge of the front wall.

each of said at least three object advancers being moveable along and aligned with a path extending between a forward position proximate to the front wall and an aft position proximate to the back wall, wherein, at least one of the first side wall and the second side wall is selectively moveable laterally between a primary position in which the selectively moveable at least one of the first side wall and the second side wall is disposed between a first path and a second path, said first path being adjacent to said second path and said selectively moveable at least one of the first side wall and the second side wall having a length that does not substantially exceed the distance between the front wall and an object advancer disposed in the aft position, and a secondary position in which the selectively moveable at least one of the first side wall and the second side wall is disposed along one of i) the path of one of said at least three object advancers while the object advancer aligned with said path is disposed in the aft position, and ii) a corridor independent of immediate proximity to both the first path and the second path, whereby, when at least one of the selectively moveable at least one of the first side wall and the second side wall is disposed in the secondary position, the display and holding device is transformed from a primary configuration having at least three primary bays to a secondary configuration having a reduced number of secondary bays with at least one of said secondary bays having a plurality of object advancers disposed therein.

20. The display and holding tray assembly of claim 14, wherein a predetermined number of the plurality of flat vertical elongated dividers have a longitudinal dimension which is greater than the distance between an object advancer disposed in the aft position and the front wall.

21. A display and holding device comprising:

a. at least three primary bays, each of said at least three primary bays being defined by a portion of a front wall, a first side wall and a second side wall, a portion of a bottom wall, and a portion of a back wall, said front wall being parallel to the back wall, said front wall further having a bottom edge connected to a front edge of the bottom wall, the bottom wall further having a back edge connected to a bottom edge of the back wall, and each of the side walls being perpendicular to and extending from the front wall; and b. at least three object advancers equal in number to the number of said at least three primary bays, one of said at least three object advancers being disposed in each of said at least three primary bays, each of said at least three object advancers being moveable along and aligned with a path extending between a forward position proximate to the front wall and an aft position proximate to the back wall, wherein at least one of the first side wall and the second side wall is selectively moveable laterally between a primary position in which the selectively moveable at least one of the first side wall and the second side wall is disposed between a first path and a second path, said first path being adjacent to said second path and said selectively moveable at least one of the first side wall and the second side wall having a length that does not substantially exceed the distance between the front wall and an object advancer disposed in the aft position, and a secondary position in which the selectively moveable at least one of the first side wall and the second side wall is disposed along one of i) the path of one of said at least three object advancers while the object advancer aligned with said path is disposed in the aft position, and ii) a corridor independent of immediate proximity to both the first path and the second path, whereby when at least one of the selectively moveable at least one of the first side wall and the second side wall is disposed in the secondary position, the display and holding device is transformed from a primary configuration having at least three primary bays to a secondary configuration having a reduced number of secondary bays with at least one of said secondary bays having a plurality of object advancers disposed therein.

22. The display and holding device of claim 21, wherein each of said selectively moveable at least one of the first side wall and the second side wall has a length that does not substantially exceed the distance between the front wall and an object advancer disposed in the aft position.

23. A display and holding tray assembly, in which a tray, has a front wall, a pair of side walls, a bottom wall, and a back wall, with the front wall being parallel to the back wall and the pair of side walls being parallel to each other, said front wall having a top edge, a bottom edge connected to a front edge of the bottom wall, and two side edges, each of which is connected respectively to a front edge of each of the pair of side walls, said bottom wall further having a pair of side edges, each of which is connected respectively to a bottom edge of each of the pair of side walls, and a back edge connected to a bottom edge of the back wall, wherein the improvement comprises:

a. a predetermined number of object advancers, each of said predetermined number of object advancers being moveable along and aligned with a path extending between a forward position proximate to the front wall and an aft position proximate to the back wall; and b. a plurality of flat vertical elongated dividers equal in number to one less than the predetermined number of object advancers, each of said plurality of flat vertical elongated dividers extends from the front wall of the tray, at least one of said dividers being laterally moveable from a primary position in which the at least one of said laterally moveable dividers is disposed between a first path and a second path, said first path being adjacent to said second path and the at least one of said laterally moveable dividers having a length that does not substantially exceed the distance between the front wall and an object advancer disposed in the aft position, and a secondary position in which the at least one of said laterally moveable dividers is disposed along one of i) the path of one of said predetermined number of object advancers while the object advancer aligned with said path is disposed in the aft position, and ii) a corridor independent of immediate proximity to both the first path and the second path, whereby, when at least one of the laterally moveable dividers is disposed in the secondary position, the improved display and holding tray is transformed from a primary configuration having a predetermined number of primary bays to a secondary configuration having a reduced number of secondary bays with at least one of said secondary bays having a plurality of object advancers disposed therein.

24. The display and holding tray assembly of claim 23, wherein a front portion of the bottom wall is sloped upwardly toward the front wall to elevate at least one object disposed in front to facilitate removal.

25. A display and holding device comprising:

a. at least three primary bays, each of said at least three primary bays being defined by a portion of a front wall, a first side wall and a second side wall, a portion of a bottom wall, and a portion of a back wall, said front wall being parallel to the back wall, said front wall further having a bottom edge connected to a front edge of the bottom wall, the bottom wall further having a back edge connected to a bottom edge of the back wall, and each of the side walls being perpendicular to and slidably connected to the front wall; and b. at least three object advancers equal in number to the number of said at least three primary bays, one of said at least three object advancers being disposed in each of said at least three primary bays, each of said at least three object advancers being moveable along and aligned with a path extending between a forward position proximate to the front wall and an aft position proximate to the back wall, wherein at least one of the first side wall and the second side wall is selectively moveable laterally between a primary position in which the selectively moveable at least one of the first side wall and the second side wall is disposed between a first path and a second path, said first path being adjacent to said second path and said selectively moveable at least one of the first side wall and the second side wall having a length that does not substantially exceed the distance between the front wall and an object advancer disposed in the aft position, and a secondary position in which the selectively moveable at least one of the first side wall and the second side wall is disposed along one of i) the path of one of said at least three object advancers while the object advancer aligned with said path is disposed in the aft position, and ii) a corridor independent of immediate proximity to both the first path and the second path, whereby when at least one of the selectively moveable at least one of the first side wall and the second side wall is disposed in the secondary position, the display and holding device is transformed from a primary configuration having at least three primary bays to a secondary configuration having a reduced number of secondary bays with at least one of said secondary bays having a plurality of object advancers disposed therein.

* * * * *